US009272876B2

(12) United States Patent
Draganovic et al.

(10) Patent No.: US 9,272,876 B2
(45) Date of Patent: Mar. 1, 2016

(54) CABLE RETRACTOR

(71) Applicant: Crestron Electronics, Inc., Rockleigh, NJ (US)

(72) Inventors: Krunoslav Draganovic, Congers, NY (US); George Feldstein, Cresskill, NJ (US)

(73) Assignee: Crestron Electronics Inc., Rockleigh, NJ (US)

( * ) Notice: Subject to any disclaimer, the term of this patent is extended or adjusted under 35 U.S.C. 154(b) by 251 days.

(21) Appl. No.: 14/135,576

(22) Filed: Dec. 20, 2013

(65) Prior Publication Data

US 2014/0262663 A1 Sep. 18, 2014

Related U.S. Application Data

(60) Provisional application No. 61/779,512, filed on Mar. 13, 2013.

(51) Int. Cl.
*B65H 75/44* (2006.01)

(52) U.S. Cl.
CPC ..... *B65H 75/4486* (2013.01); *B65H 75/4449* (2013.01); *B65H 75/4484* (2013.01); *B65H 2701/34* (2013.01)

(58) Field of Classification Search
CPC ..... H02G 11/02; B65H 75/4486; B65H 2701/34; B65H 75/4484; B65H 75/4431; B65H 75/44; B65H 75/4489; H04M 1/15
USPC ..... 191/12.2 A
See application file for complete search history.

(56) References Cited

U.S. PATENT DOCUMENTS

| | | | | |
|---|---|---|---|---|
| 2,159,004 | A | 5/1939 | Bosch, Jr. | |
| 2,619,665 | A | 12/1952 | Hopkins et al. | |
| 3,480,227 | A | 11/1969 | Matthews | |
| 3,657,491 | A | 4/1972 | Ryder et al. | |
| 3,773,987 | A | 11/1973 | Davis et al. | |
| 3,809,331 | A | 5/1974 | Gaul | |
| 3,958,396 | A * | 5/1976 | Keiley | A01B 69/00 56/10.5 |
| 4,901,938 | A | 2/1990 | Cantley et al. | |
| 5,279,473 | A | 1/1994 | Rozon | |
| 5,453,585 | A * | 9/1995 | Lenz | H02G 11/02 191/12.2 R |
| 5,590,749 | A * | 1/1997 | Wagner | H02G 11/02 191/12.4 |
| 5,957,399 | A | 9/1999 | Siana, Jr. | |
| 6,234,417 | B1 | 5/2001 | Sauder et al. | |
| 6,375,109 | B1 * | 4/2002 | Liao | H04M 1/15 242/378 |
| 6,483,033 | B1 | 11/2002 | Simoes et al. | |
| 6,484,958 | B1 | 11/2002 | Xue et al. | |
| 7,364,109 | B2 | 4/2008 | Kuo | |
| 7,438,258 | B2 | 10/2008 | Chen | |
| 8,336,688 | B2 | 12/2012 | Chen et al. | |
| 2012/0138724 | A1 | 6/2012 | Chen et al. | |

* cited by examiner

*Primary Examiner* — Mark Le
(74) *Attorney, Agent, or Firm* — Crestron Electronics Inc.

(57) ABSTRACT

A cable retractor for releasing and retracting an application cable. a cable retractor comprises a base; a spool having sides, the spool rotatably secured to the base to permit the application cable to be wrapped around the spool; a mandrel disposed concentrically within the spool, the mandrel being rotationally secured to the base to prevent axial rotation of the mandrel relative to the base; and the mandrel further having a recessed groove running lengthwise, and an internal cable having an outer connector and inner connector, the outer connector being connected through the spool to one end of the application cable, and the inner connector being exposed at one end of the mandrel from within the recessed groove.

3 Claims, 8 Drawing Sheets

CABLE RETRACTOR

CROSS REFERENCE TO RELATED APPLICATION

This application claims the benefit of provisional application Ser. No. 61/779,512 filed Mar. 3, 2013.

BACKGROUND OF THE INVENTION

1. Field of the Invention

The present invention relates to a mechanism for storing and retracting a cable. More particularly, the invention relates to a cable retractor for facilitating the withdrawal and retraction of a length of cable.

2. Description of the Prior Art

The storing and retracting of cords has traditionally been a problem for conference room end users. For example, they can become tangled with other cords, damaged during operation, or appear aesthetically unpleasing when they hang freely from tables. Additionally, the end user may become injured if they become entangled or trip over the cord.

Commonly cable retractors use a linear action approach to store cables. Traditionally, cable retractors are mounted under a conference room table or desk.

One problem with common cable retractors is that tend to be physically large. Another problem is that their cords have a tendency to become twisted when wound around a drum or axle.

Prior solutions include the use slip-rings, brushes, optical or electromagnetic couple devices or other components to avoid the twisting of the cord. However, these solutions make the overall design cable retractors more complex.

Accordingly, there is room for improvement in the art.

SUMMARY OF THE INVENTION

It is to be understood that both the general and detailed descriptions that follow are exemplary and explanatory only and are not restrictive of the invention.

DISCLOSURE OF INVENTION

The present invention provides a cable retractor for releasing and retracting an application cable. In one embodiment, for example, a cable retractor comprises a base; a spool having sides, the spool rotatably secured to the base to permit the application cable to be wrapped around the spool; a mandrel disposed concentrically within the spool, the mandrel being rotationally secured to the base to prevent axial rotation of the mandrel relative to the base; and the mandrel further having a recessed groove running lengthwise, and an internal cable having an outer connector and inner connector, the outer connector being connected through the spool to one end of the application cable, and the inner connector being exposed at one end of the mandrel from within the recessed groove.

In one aspect, for example, the cable retractor further is described having a spool rim disposed on the sides of the spool, the spool rim forming a raised peripheral lip to prevent the application cable from slipping off the spool.

In yet another embodiment, for example, the cable retractor is described further comprising a retraction motor fixably mounted relative to the base; a belt drum disposed on the outside of the spool; and a retraction drive belt coupling the retraction motor and belt drum together, the retraction drive belt mechanically allowing the retraction motor to rotationally drive the spool using the belt drum.

In still another embodiment, a cable retractor is described comprising a manual switch; a payout sensor; a retraction sensor; a retraction motor fixably mounted relative to the base; a controller configured to detect changes in the manual switch, the payout sensor, and the retraction sensor, causes the motor to turn in a specified direction to assist in expelling or retracting the application cable; a worm gear disposed slidably over a worm shaft, the worm gear being permitted to travel axially along a plurality of spline grooves, the worm gear further having a flange plates abutting each side; a payout spring and a retraction spring opposing each side of the flange plates; a spool gear secured to spool for translating motion to the worm gear; a first compression plate for securing the outer end the retraction spring on the worm shaft; and a second compression plate for securing an outer end of the payout spring on the worm shaft.

In another aspect, a cable retractor includes the payout sensor being configured to cause a controller to expel the application cable; the retraction sensor being configured to cause a controller to retract the application cable; and the manual switch being configured to either cause a controller to expel or retract the application cable.

BRIEF DESCRIPTION OF THE DRAWINGS

The accompanying figures further illustrate the present invention. The components in the drawings are not necessarily drawn to scale, emphasis instead being placed upon clearly illustrating the principles of the present invention. In the drawings, like reference numerals designate corresponding parts throughout the several views.

LIST OF REFERENCE NUMBERS FOR THE MAJOR ELEMENTS IN THE DRAWING

Figure 1:
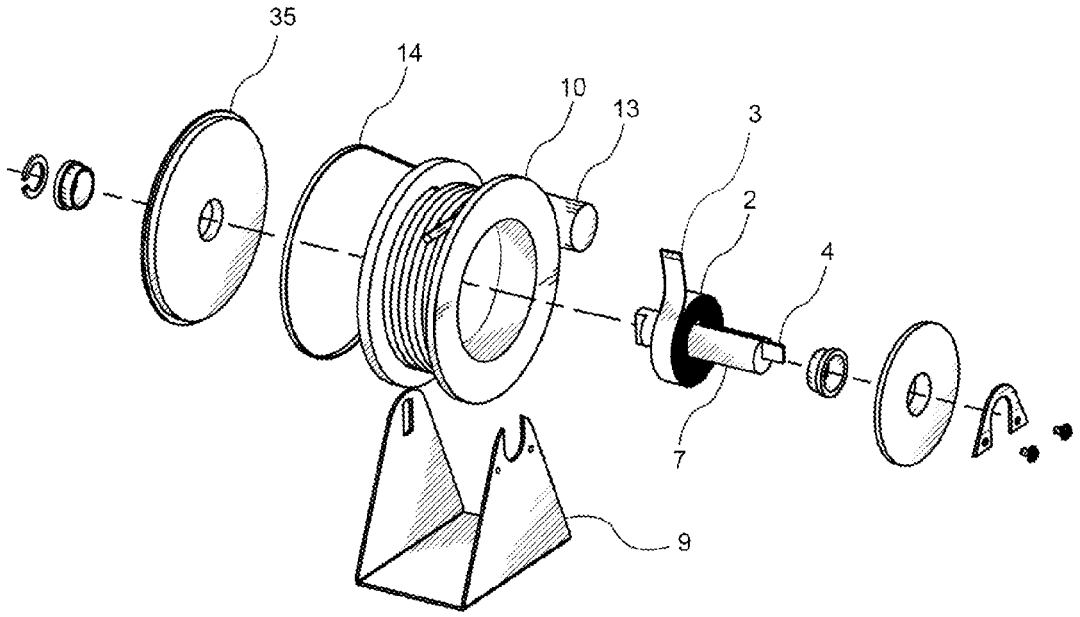
FIG. 1 is an elevational perspective exploded view of a belt drive according to an embodiment of the present invention.

The following is a list of the major elements in the drawings in numerical order.

1 APPLICATION CABLE
2 INTERNAL CABLE
3 INTERNAL CABLE OUTER CONNECTOR
4 INTERNAL CABLE INNER CONNECTOR
7 MANDREL
9 BASE
10 SPOOL
11 SPOOL RIM
13 RETRACTION MOTOR
14 RETRACTION DRIVE BELT
19 CONTROLLER

20 MANUAL SWITCH
24 PAYOUT SENSOR
25 RETRACTION SENSOR
26 WORM GEAR
27 WORM SHAFT
28 SPLINE
30 FLANGE PLATES
31 SPOOL GEAR
32 PAYOUT SPRING
33 RETRACTION SPRING
35 BELT DRUM
36 COMPRESSION PLATE

DESCRIPTION OF THE ENABLING EMBODIMENT

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art having possession of this disclosure, are to be considered within the scope of the invention.

MODE(S) FOR CARRYING OUT THE INVENTION

It is to be noted that the following exemplary embodiments are only illustrative and many alterations in the described embodiments are possible. Some embodiments of the invention will next be described with reference to the figures, wherein like numerals indicate corresponding parts throughout the several views.

Figure 2:
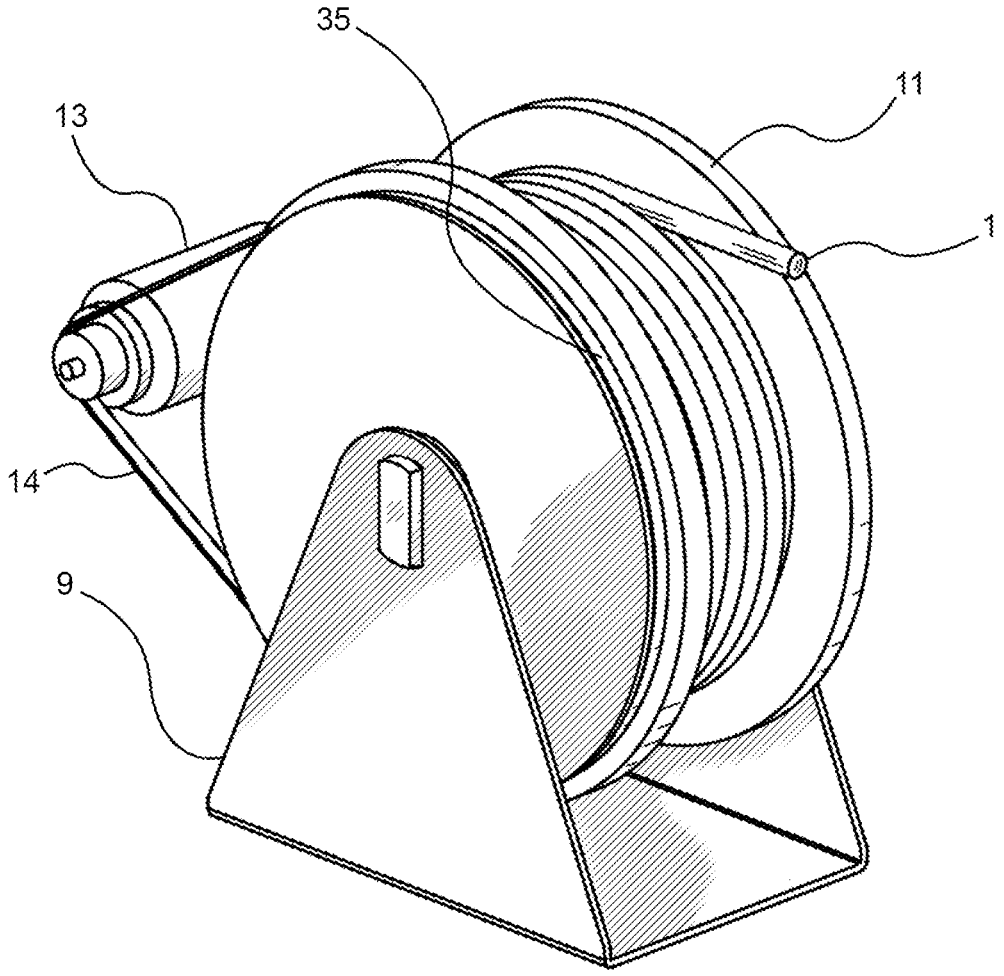
FIG. 2 is a side perspective view of a cable retractor incorporating a belt drive, according to one embodiment of the present invention.
Figure 3:
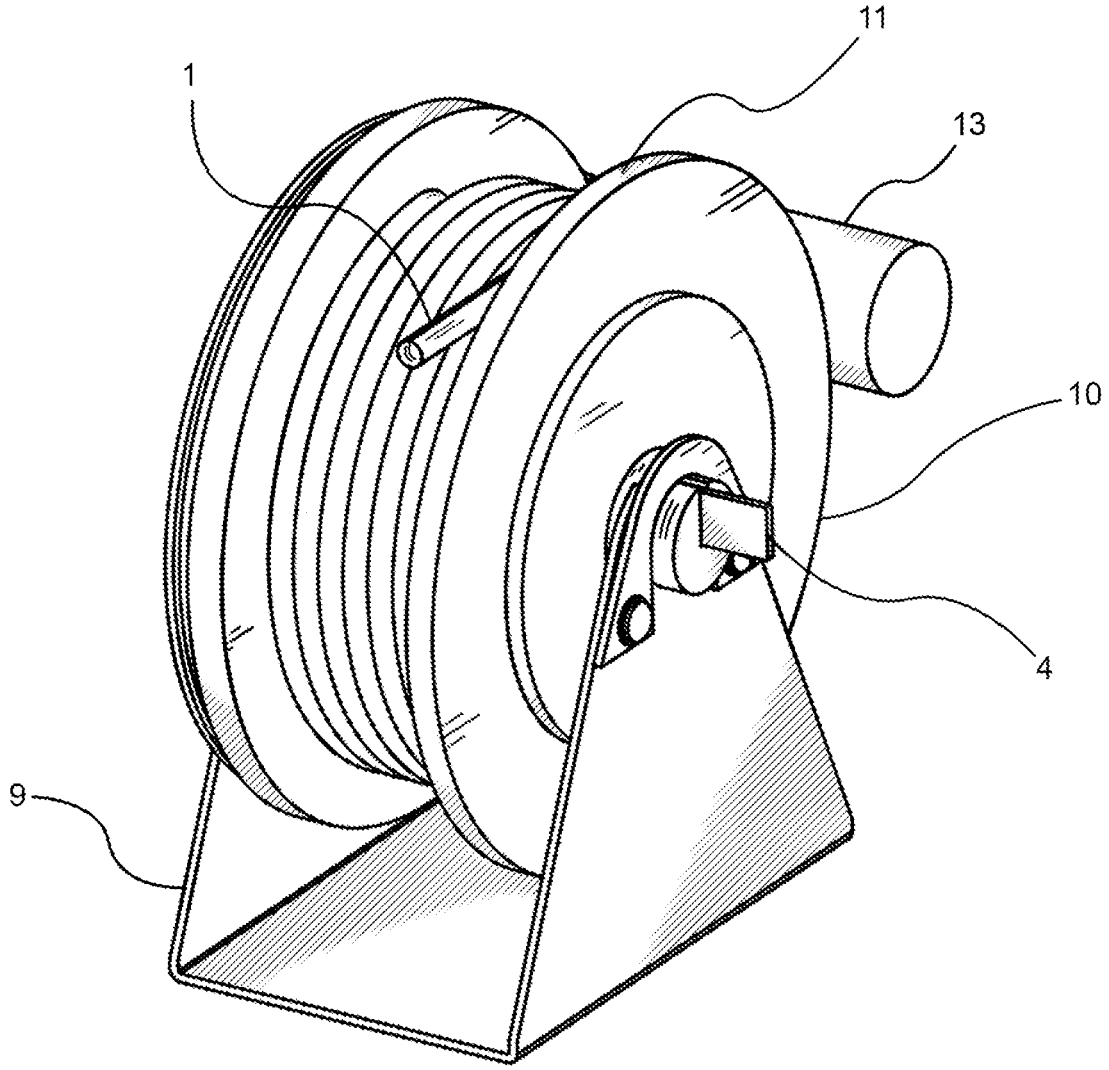
FIG. 3 is a rear perspective elevational view of a cable retractor incorporating a belt drive, according to one embodiment of the present invention.

FIG. 1 is an elevational perspective exploded view of a belt drive illustrating an application cable 1 cord retractor that retracts an application cable 1 via the rotational action of a spool 10. FIG. 2 is a side perspective view of the assembled cable retractor of FIG. 1, and FIG. 3 is a rear perspective elevational view of the cable retractor of FIG. 2.

The cable cord retractor disclosed maintains an electrical path from the stationary internal cable inner connector 4 to the retractable end of the application cable 1. In this regard, both reliability and performance are improved, physical size is reduced, a fewer number of components are needed thus being easier to manufacture.

According to the various embodiments, the ratio of length that can be wound over two different diameter spools 10 and/or mandrel 7 arrangements is utilized. In the preferred embodiment, the mandrel 7 is stationary and a spool 10 rotates.

According to an embodiment, a mounted cable retractor comprises a winding spool 10 having a diameter $D_2$ for retracting an application cable. Naturally, more of the application cable 1 is retracted when the N number of windings around the spool 10 is increased. A separate internal cable 2 is coiled over a mandrel 7 having a diameter $D_1$. The diameter $D_2$ is larger in size than diameter $D_1$. Where $D_1$ can be found, such that, when N number of turns are un-spooled, the internal cable 2 (a flat ribbon) will distribute itself and still be contained inside the larger diameter spool.

According to an embodiment, a mounted cable retractor comprises a winding spool 10 having a diameter $D_2$ for retracting an application cable 1. Naturally, more of the application cable 1 is retracted when the N number of windings around the spool 10 is increased. A separate internal cable 2 is coiled over a mandrel 7 having a diameter $D_1$. The diameter is larger in size than diameter $D_1$ where $D_1$ can be found, such that, when N number of turns are un-spooled, the internal cable 2 (a flat ribbon) will distribute itself and still be contained inside the larger diameter spool 10.

For example, assume that the application cable 1 in one embodiment is length l, and that it can be spooled over a diameter $D_2$ in a number of turns equal Further assume the an internal cable 2 is a thin ribbon cable (of thickness h and length l) is spooled over a mandrel 7 of diameter $D_1$ in a N number of turns. In this example, the "Pay-out length" is:

$$L=n\times D_2\times\pi$$

Accordingly, the internal cable 2 length l can be described by the following equation:

$$l=\pi\times\{D_1\times N+2h(n-1)\}$$

Thereby yielding a tightly wound internal cable 2 and mandrel 7 with a combined diameter equal to:

$$D_1+(2h\times N)$$

When the rotating part of the mechanism (i.e. the spool 10) rotates n turns to payout the retractor application cable 1, the occupied diameter of the internal cable 2 increases to a value, $D_{exp}$, given by:

$$D_{exp}=\frac{l}{(N-n)}\times\pi$$

Therefore, in order for the ribbon to always be contained inside the rotating spool 10 ($D_2$) the appropriate relationship between $D_1$, $D_2$, N, n, and h can be determined.

In another embodiment, the cable retractor may include two spools 10 so that the action of the ribbon internal cable (2) could be arranged side-by-side with the larger "pay-out" spool 10.

Figure 4:
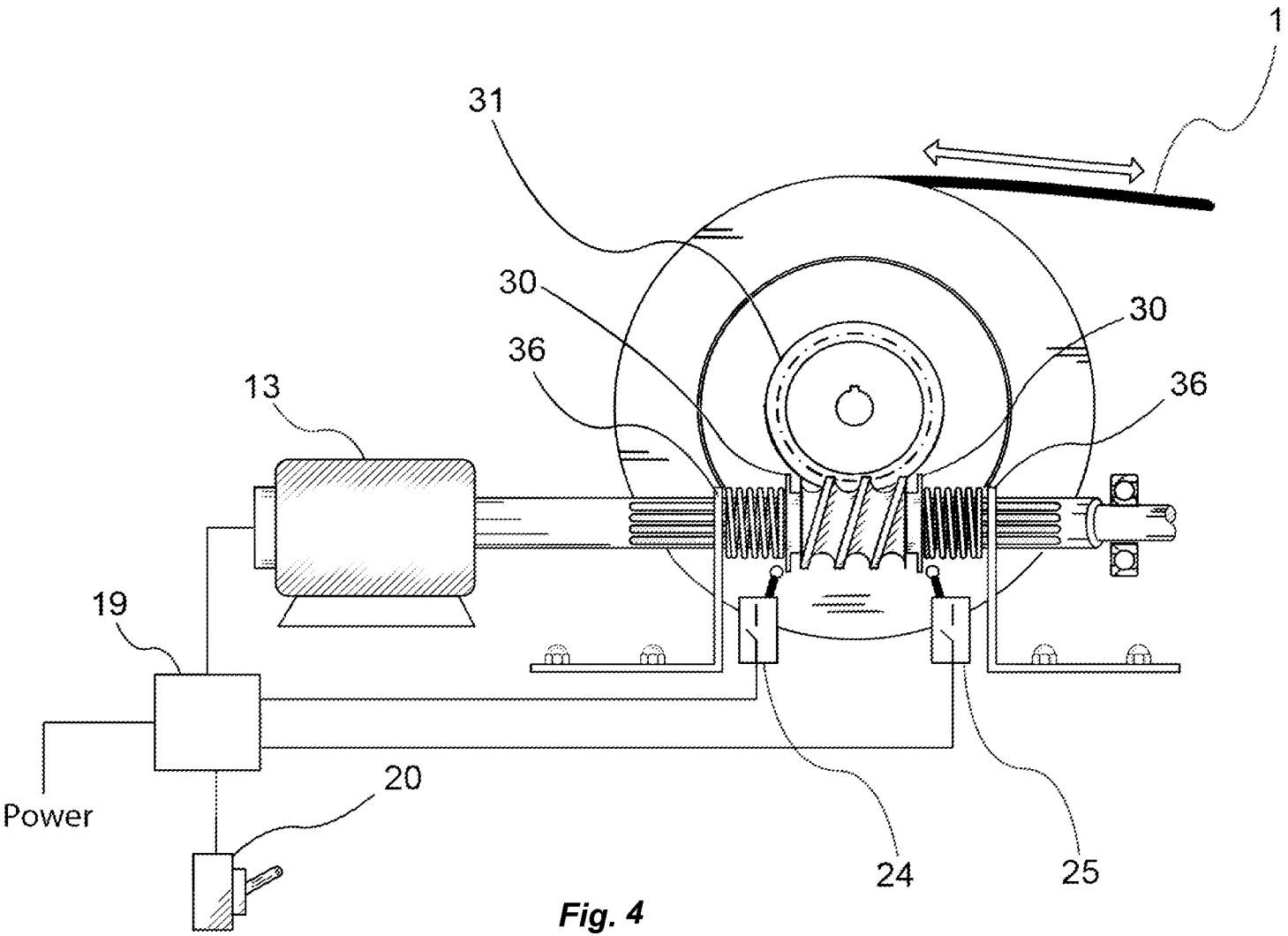
FIG. 4 is a side view of a cable retractor incorporating a worm motor drive, according to another embodiment of the present invention.
Figure 5:
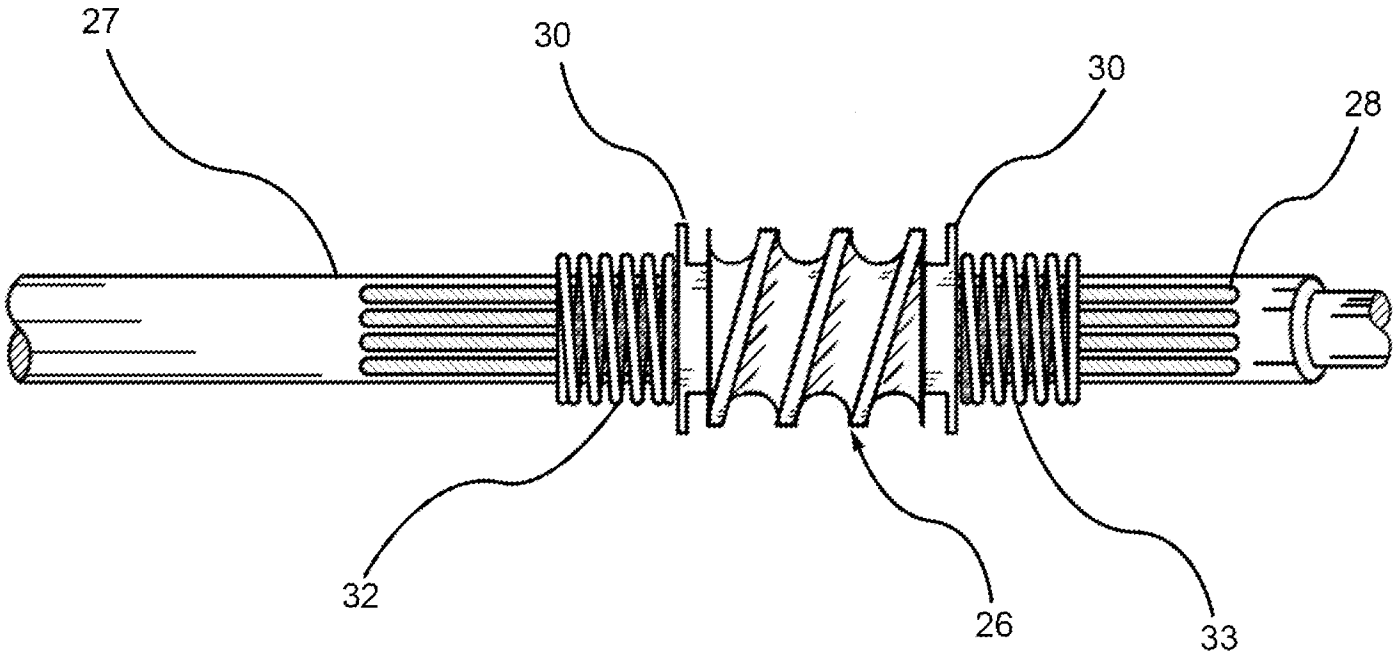
FIG. 5 is a partial side view of a worm shaft assembly, according to an embodiment of the present invention.
Figure 6:
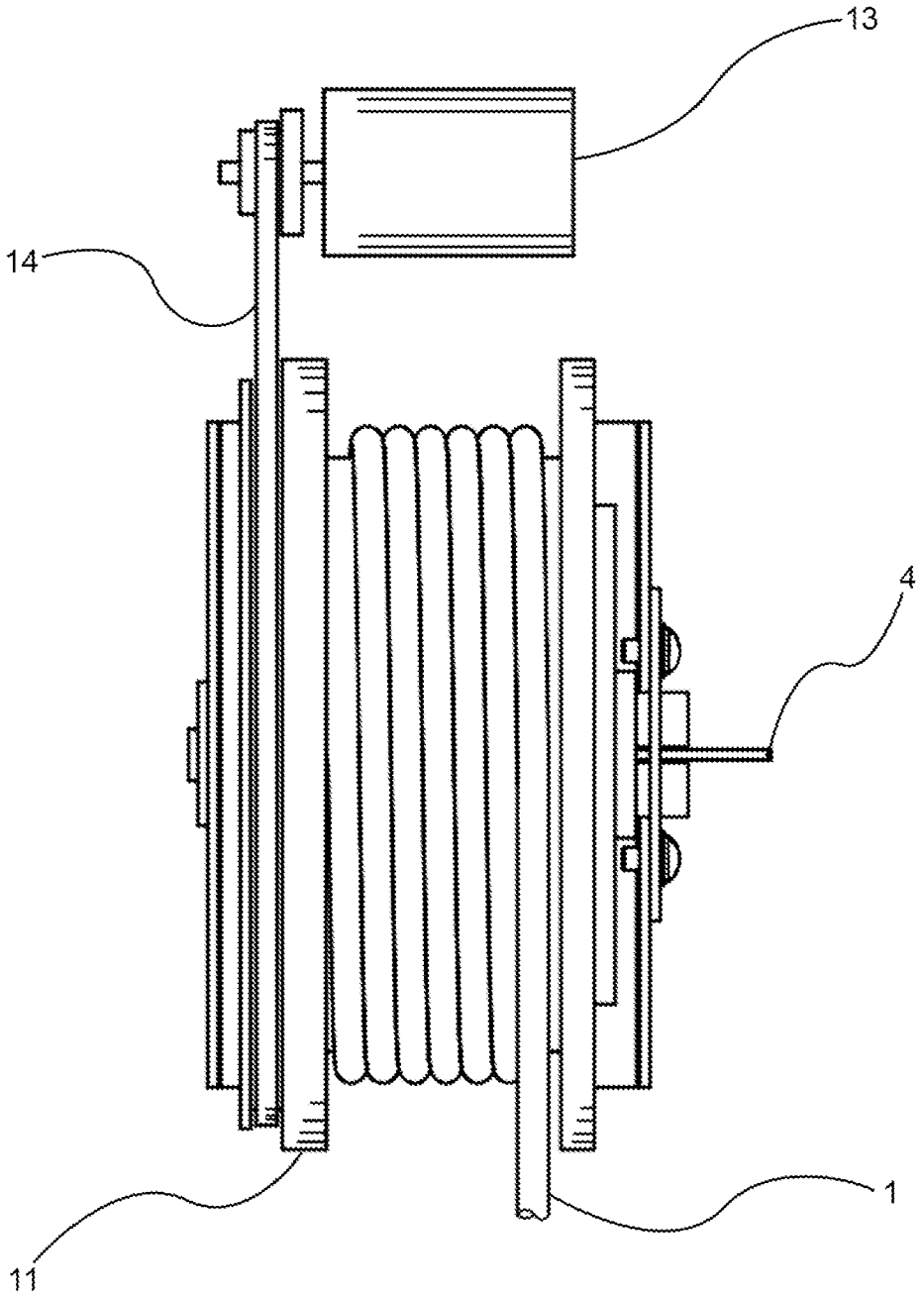
FIG. 6 is a top view of a cable retractor incorporating a belt drive, according to an embodiment of the present invention.

The present invention may use an active mechanism to facilitate the extension and retraction of the application cable 1. Referring to FIG. 4, shown is a side view of a cable retractor incorporating a worm motor drive. In this embodiment, electrical retraction motor 13 helps to assist in the retraction of the application cable 1. For example, an end-user can push manual switch 20 to activate the electrical system to retract the cord.

In an alternate embodiment, instead of the button, the retractor may include a sensor system to sense the motion of, for example, an end-user's hand, to activate the electrical system to retract the application cable 1. The worm gear 26 would engage with the worm shaft 27, and can be made to rotate when the worm shaft 27 rotates.

The worm gear 26 also has a small degree of freedom to move axially along the shaft while engaged by the spline 28 inscribed onto the shaft. The axial freedom is limited by the length of compression that ($SPRING_1$) Payout Spring 32 and ($SPRING_2$) Retraction Spring 33 allow. That axial motion is caused by the rotation of the spool 10 when the cable is tugged on, or pushed inward. Alternatively, the cable can be "pulled-out" and then retracted by the actuation of a manual switch 20.

The small axial travel that the worm gear 26 is capable of is sufficient to actuate micro-switches, e.g., payout sensor 24 and retraction sensor 25, positioned next to the corresponding Flange Plates 30. The micro-switches in turn send a signal to the controller 19 that will cause the retraction motor 13 to turn the worm shaft 27 in the appropriate direction so as to assist the delivery or retraction of the cable. The mechanism includes a spool gear 31 attached to the spool 10 which further stores the internal cable 2.

Figure 7:
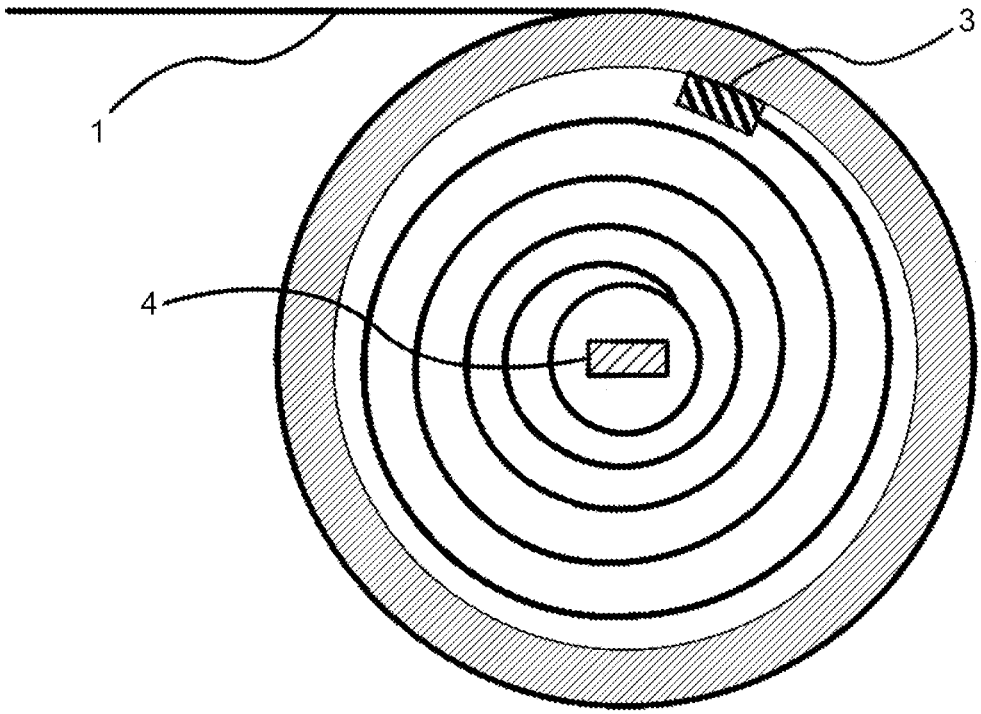
FIG. 7 is a partial sectional view illustrating an internal cable loosely wound.
Figure 8:
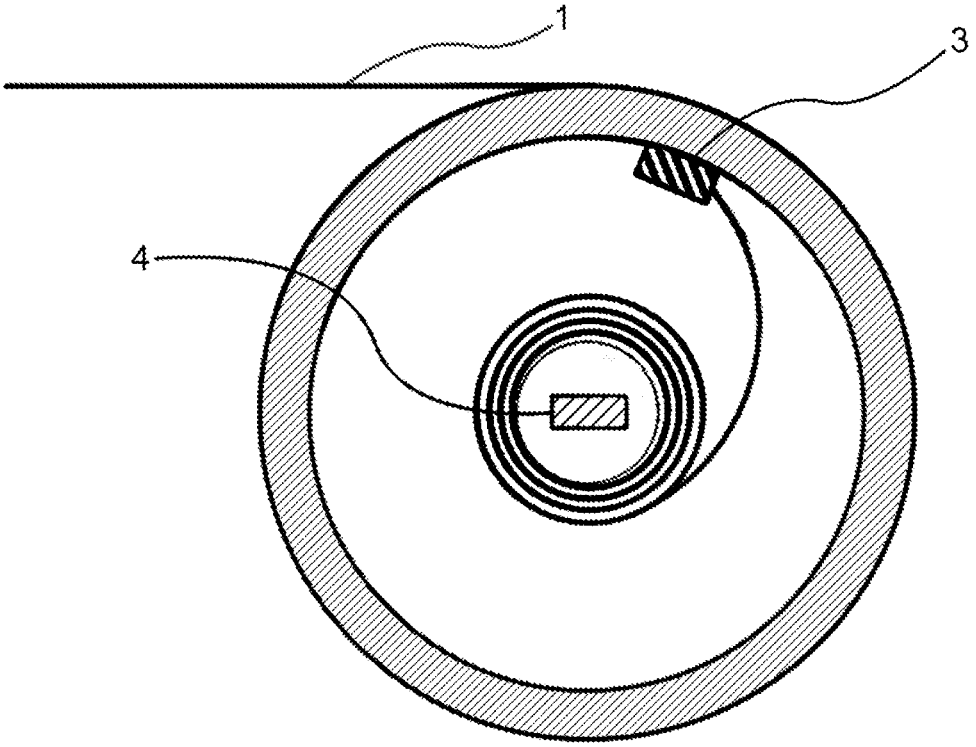
FIG. 8 is a partial sectional view illustrating an internal cable tightly wound.

FIG. 7 is a partial sectional view illustrating an internal cable 2 loosely wound and FIG. 8 is a partial sectional view illustrating an internal cable 2 tightly wound. As can be seen, the use of a thin flat ribbon cable is preferred in order to further improve the ratio of lengths that can be achieved.

If the "Pay-out length" of the application cable 1 is:

$$L=n\times\pi\times D_2$$

Then Ribbon length l is described by calculating the Archimedian spiral curve length. For a spiral stating at $R_0$ (mandrel 7 radius) and ending at $R_f$, the final radius of the tightly wound ribbon is:

$$r=a+b\theta$$

Where r is the radial position of a point p on the ribbon, and b is the pitch per radian, in polar coordinates.

The length of the ribbon for a starting radius a after N turns of the angular parameter θ.

From that, then calculate the final diameter of the tightly wound ribbon. The ribbon follows an Archimedean spiral and its length can be obtained by calculus. After converting to Cartesian coordinates the length of a curve can be obtained by:

$$l=\int\sqrt{(x'(\theta))^2+(y'(\theta))^2}\,d\theta$$

After solving and simplifying by eliminating terms of negligible value the following integration can be obtained:

$$l = R_0\theta + \frac{h}{4\pi}\theta^2\Big]_0^{2\pi N}$$

This integration yields an acceptable calculation of the ribbon length but makes it somewhat cumbersome to obtain the diameters as we need to estimate, which are the Expanded Diameter "$D_{unrolled}$" of the ribbon and the Tightly Spooled Diameter.

By examining the figure above, the following can be stated:

$$\text{Length} = \frac{\text{"area of exposed edge"}}{\text{"thickness of ribbon"}}$$

If the length of the ribbon is known (l), as well as thickness of the ribbon (h) and the diameter of the mandrel 7 on which it is wound ($D_1$), the following relation can easily be established:

$$D_{spooled} = \sqrt{\frac{4}{\pi}\times L\times h + D_1^2}$$

From this relation the number of turns N can also be estimated:

$$N = \frac{D_{spooled} - D_1}{2h}$$

When the rotating part of the mechanism (Spool 10) rotates n turns to payout the retractor application cable 1, the occupied diameter of the Ribbon increases from a value to a new value "D-unrolled", or simply $D_{unrolled}$.

Now, if we pay out a length of cable L (Cable to Application) which was wound over the spool 10 of diameter, $D_2$, the number of turns to accomplish that can be obtained from the relationship:

$$L = n\times\pi\times D_2$$

and $$n = \frac{L}{\pi\times D_2}$$

After the application cable 1 is extended a length l, the internal cable 2 will be spooled over a lower number of turns (N−n), but will still be of length l.

The average diameter of the unrolled (un-ferruled) ribbon is:

$$D_{avg\ unrolled} = \frac{l}{(N-n)\times\pi}$$

From which the unrolled diameter can be calculated:

$$D_{unrolled} = \frac{2l}{(N-n)\times\pi} - D_1$$

Furthermore, in accordance with the disclosed exemplary embodiments, the following inequality should verify:

$$D_2 \geq D_{unrolled}$$

In order for the Ribbon to always be contained inside the rotating Spool 10 ($D_2$) the appropriate relation between $D_1$, $D_2$, N, n and h can be determined for any given embodiment of this invention.

ALTERNATE EMBODIMENTS

Variations, modifications, and other implementations of what is described herein may occur to those of ordinary skill in the art without departing from the spirit and scope of the invention. Accordingly, the invention is not to be defined only by the preceding illustrative description.

What is claimed is:

1. A cable retractor for releasing and retracting an application cable (1) comprising:

a base (9);

a spool (10) having sides, said spool (10) rotatably secured to said base (9) to permit said application cable (1) to be wrapped around said spool (10);

a mandrel (7) disposed concentrically within said spool (10), said mandrel (7) being rotationally secured to said base (9) to prevent axial rotation of said mandrel (7) relative to said base (9); and said mandrel (7) further having a recessed groove running lengthwise, an internal cable (2) having an outer connector (3) and inner connector (4), said outer connector (3) being connected through said spool (10) to one end of said application cable (1), and said inner connector (4) being exposed at one end of said mandrel (7) from within said recessed groove a manual switch (20);

a payout sensor (24);

a retraction sensor (25);

a retraction motor (13) fixably mounted relative to said base (9);

a controller (19) configured to detect changes in said manual switch (20), said payout sensor (24), and said retraction sensor (25), causes said motor to turn in a specified direction to assist in expelling or retracting said application cable (1);

a worm gear (26) disposed slidably over a worm shaft (27), said worm gear (26) being permitted to travel axially along a plurality of spline (28) grooves, said worm gear (26) further having a flange plates (30) abutting each side;

a payout spring (32) and a retraction spring (33) opposing each side of said flange plates (30);

a spool gear (31) secured to spool (10) for translating motion to said worm gear (26);

a first compression plate (36) for securing said outer end said retraction spring (33) on said worm shaft (27); and a second compression plate (36) for securing an outer end of said payout spring (32) on said worm shaft (27).

2. The cable retractor of claim 1, wherein said internal cable (2) is a ribbon cable.

3. The cable retractor of claim 2, wherein:

said payout sensor (24) is configured to cause a controller (19) to expel said application cable (1);

said retraction sensor (25) is configured to cause a controller (19) to retract said application cable (1); and said manual switch (20) is configured to cause a controller (19) to expel or retract said application cable (1).

* * * * *